United States Patent [19]

Werner et al.

[11] 4,278,061

[45] Jul. 14, 1981

[54] METHOD AND APPARATUS FOR ADJUSTING FUEL INJECTION CONTROL

[75] Inventors: Peter Werner, Stuttgart; Ulrich Drews, Vaihingen, both of Fed. Rep. of Germany

[73] Assignee: Robert Bosch GmbH, Stuttgart, Fed. Rep. of Germany

[21] Appl. No.: 859,509

[22] Filed: Dec. 12, 1977

[30] Foreign Application Priority Data

Jan. 8, 1977 [DE] Fed. Rep. of Germany ..... 2700628

[51] Int. Cl.[3] ..... F02D 5/02

[52] U.S. Cl. ..... 123/483; 123/485; 307/267

[58] Field of Search ..... 123/32 EA, 32 EH, 32 EG, 123/32 EK, 117 R; 307/267; 328/58

[56] References Cited

U.S. PATENT DOCUMENTS

| | | | |
|---|---|---|---|
| 3,429,302 | 2/1969 | Scholl | 123/32 EA |
| 3,483,851 | 12/1969 | Reichardt | 123/32 EA |
| 3,734,067 | 5/1973 | Glockler et al. | 123/32 EA |
| 3,741,171 | 6/1973 | Dautel | 123/32 EA |
| 3,750,631 | 8/1973 | Scholl et al. | 123/32 EA |
| 3,771,502 | 11/1973 | Reddy | 123/32 EA |
| 3,824,967 | 7/1974 | Gordon | 123/32 EA |
| 3,919,981 | 11/1975 | Reddy | 123/32 EA |
| 4,040,397 | 8/1977 | Leichle | 123/32 EA |

FOREIGN PATENT DOCUMENTS

| | | | |
|---|---|---|---|
| 2311936 | 12/1976 | France | 123/32 EG |
| 1445709 | 8/1976 | United Kingdom | 123/32 EA |

*Primary Examiner*—Charles J. Myhre
*Assistant Examiner*—Andrew M. Dolinar
*Attorney, Agent, or Firm*—Edwin E. Greigg

[57] ABSTRACT

A fuel injection system of an internal combustion engine generates valve-actuating pulses for actuating electromagnetic fuel injection valves. The length, or duration, of these valve actuating pulses is a function of various engine conditions and they are generated by a pulse-length multiplying circuit from preliminary control pulses derived from two basic engine variables, e.g. engine speed and air flow rate. In order to compensate for the decreasing pressure drop across the injection valve orifice at high engine load due to increasing manifold pressure, the invention describes methods for lengthening the fuel valve-actuating pulses by engaging the pulse-length multiplying circuit, in order to change the charging or discharging times of the timing capacitor therein. Another method proposed is to engage the battery-voltage compensation circuit in the system to lengthen the valve-actuating pulses. Electronic circuitry to perform these corrections is also described.

3 Claims, 11 Drawing Figures

METHOD AND APPARATUS FOR ADJUSTING FUEL INJECTION CONTROL

BACKGROUND OF THE INVENTION

The invention relates to the fuel injection systems of internal combustion engines. More particularly, the invention relates to fuel injection systems using electromagnetic injection valves that are controlled by injection control pulses. The duration or length of the control pulse determines the time of opening of the electromagnetic valves and thereby determines the amount of fuel fed to the engine, which varies for various operational conditions. The present invention is based on the recognition that the pressure difference across the orifice of the injection valve which influences the amount of fuel delivered is itself dependent on engine load. This is so because the induction tube pressure changes as a function of the load on the engine, i.e. depending on the position of the throttle valve. At relatively high loads, when the throttle valve is wide open, the induction tube pressure is substantially higher than is the case at low load and with a nearly closed throttle valve, where the induction tube pressure is a possibly high vacuum. Accordingly, the pressure gradient across the injection valve, i.e. the difference between the fuel pressure within the valve and the induction tube pressure, is reduced during conditions of high engine load and the engine thus receives relatively less fuel under such conditions. The fuel quantity may be reduced by as much as ten percent and more due to the above-described set of circumstances.

OBJECT AND SUMMARY OF THE INVENTION

It is thus a principal object of the present invention to describe a method and an apparatus for exercising the method to obviate the above disadvantages and to prolong the normal fuel injection control pulses delivered by the fuel injection system in a load-dependent manner. The amount of prolongation is made dependent on the duration of the original fuel injection pulse; the duration of that original pulse in turn is dependent on engine speed and air flow rate in known manner. The invention is intended to be used with known electric or electronic fuel injection systems which include a control circuit having a so-called dividing control multivibrator which generates a pre-control pulse "tp". The length of the pre-control pulse tp is derived from two main control variables, namely the engine speed and the air quantity supplied to the cylinders per stroke or, alternatively, the induction tube pressure. In such injection systems as generate the pre-control pulse on the basis of induction tube pressure, the above dependent load-dependence of injection time on induction tube pressure is not present for it may be corrected by a special response in the pressure sensor. However, those fuel injection systems in which the control variable is the air quantity per unit time, i.e. the air flow rate, and in which the fuel pressure at the injection valves is made constant for reasons of simplicity and economy, i.e. which do not have a necessarily very complicated control circuit for changing the fuel pressure as a function of induction tube pressure, the differential pressure across the injection valves is necessarily variable and depends on the engine load so that the fuel quantity will not correspond to the optimum amount unless corrected in some way. It is this correction of the control pulses from a fuel injection system of this type which is the essence of the present invention.

Thus it is a concurrent object of the present invention to provide a fuel-air mixture in the proper stoichiometric ratio or some other desirable ratio for all operational states of the engine without any error introduced by the prevailing load condition of the engine.

It is yet another object of the invention to describe a variety of possibilities for compensating for the load-dependent induction tube pressure and for generating the prolonged fuel injection control pulse without, however, requiring the presence of a separate pressure sensor for the induction tube pressure. Thus it is a special object of the invention to correct the fuel injection control pulses entirely electronically within the normal electronic fuel controller.

The invention is suitable for generating load-dependent corrections of any desired character, for example, corrections which follow a special engine operating data field. Furthermore, the invention is not limited to fuel preparation systems which meter out fuel to a measured amount of air but may be used generally for all systems that employ intermittent fuel injection.

The invention will be better understood as well as further objects and advantages thereof become more apparent from the ensuing detailed description of various embodiments taken in conjunction with the drawing.

DESCRIPTION OF THE PREFERRED EMBODIMENTS

In order to provide a load-dependent correction of the fuel injection control pulses, the invention makes use of the fact that the primary control pulse generated by the so-called dividing control multivibrator as a function of engine speed and air flow rate is in fact a variable which is an approximate measure of the induction tube pressure. The same is true of the final fuel injection control pulses generated by the fuel injection system. The correction to be made is effected by prolonging the output, i.e., the unstable state of the control multivibrator, by an amount up to approximately ten percent for example, or more, for high values of that unstable state, i.e. for a high induction tube pressure. This load-dependent correction may be performed in various ways in the known electronic controller and these are described in detail in the material below. The first of the possible ways of correcting the injection pulse for load or, more exactly, for compensating the pulse for the above-described reduced pressure gradient at high engine load, is based on engaging the normally present voltage correction mechanism within the electronic controller of the known fuel injection system.

The known voltage correction mechanism is based on the fact that the electromagnetic injection valves are subject to a response delay "tan" and a closure delay "tab". Both of these times are dependent on the effective vehicle battery voltage, i.e. on the actuation voltage. If the injection valve is actuated by a control pulse of duration "tg", the actual opening time which determines the amount of fuel delivered will be $$ti = tg - \tan + \mathrm{tab} = tg - tv.$$

The difference tv=tan−tab, which will be henceforth referred to as the valve delay time, is dependent on the battery voltage and is positive in the entire battery voltage domain. Its influence on the amount of fuel injected may be compensated by making the duration "tg" of the injection pulses not strictly proportional to the unstable time constant of the dividing control multivibrator and hence to the ratio Q/n, i.e. the ratio of air per unit of time, but rather to correct it with an additive and voltage-dependent correction time "ts", i.e.

$$tg = M \cdot tp + ts, \text{ with } \mathrm{tp} \propto Q/n.$$

Figure 1:
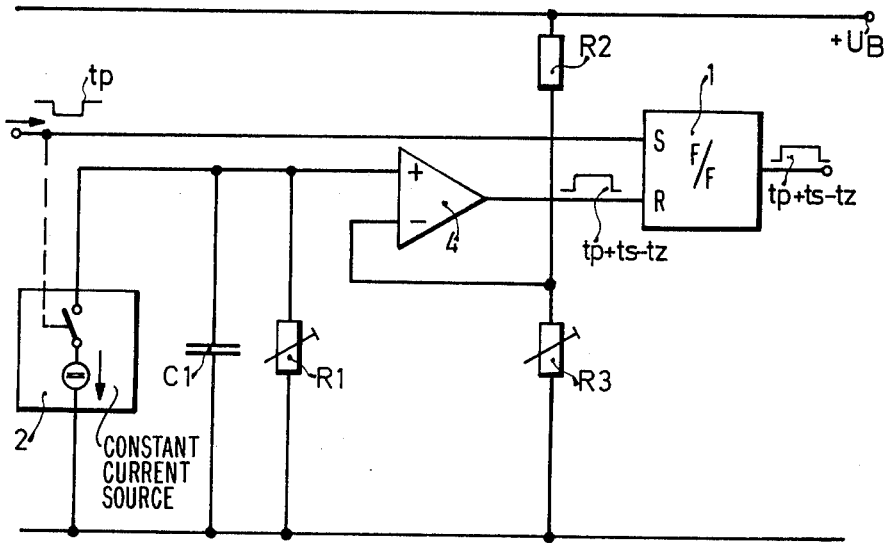
FIG. 1 is a circuit diagram of a circuit for performing a load correction by engaging a voltage-correcting circuit within the fuel injection system.

This correcting time "ts", which in known fuel injection systems is used to compensate for changing battery voltage, is obtained by means of the circuit illustrated in FIG. 1. This circuit is now modified according to the present invention to serve at the same time for what has been previously defined as load correction, for the change of the differential pressure across the injection valve as a function of engine load. The factor "M" in the above equation is the multiplication factor of the multiplier circuit which is connected behind the control multivibrator and which serves to generate the final control pulses "ti" from the pre-control pulses of length "tp" on the basis of various correction parameters. The final opening time of the valves, i.e. the length of the fuel control pulses is $$ti = M \cdot tp + ts' - tv.$$

In this equation, the term "ts'" is the duration of the battery voltage correction time "ts" as modified according to the present invention by a constant time "tz", i.e. in the manner ts'=ts−tz. In the known fuel injection system, the area of the battery voltage correction is to insure that ts=tv so that $$ti = M \cdot tp - tz.$$

In other words, the actual opening time "ti" will have been modified by the present invention for the purpose of load correction by a constant time "tz" which was done by changing the normal voltage correction time "ts" while retaining the original voltage-dependent correction completely.

When the control pulses "tp" are small, the amount of modification by the time "tz" has a relatively greater effect than is the case when the control pulses "tp" are long. The multiplication factor of the multiplier circuit is normally adjusted to be equal to the value M=2. The reduction of the pulse length "ti" for a very small control pulse tp=tpmin may be compensated for if necessary by increasing the factor M so that the desired increase of the injection time for high engine load, i.e. for long pre-control pulses "tp", is obtained.

The circuitry for performing the known voltage correction, as illustrated in FIG. 1, includes a bistable flip-flop 1 which receives the above-mentioned pre-control pulses "tp" at its set input. At the same time, the pre-control pulse "tp" is used to close a switch causing a constant current source 2 to charge a capacitor C1 to a constant, stabilized voltage $U_Z$. At the end of the pulse "tp", the capacitor C1 discharges through the adjustable resistor R1. When the voltage correction time "ts" has passed, the voltage at the capacitor C1 falls below that present at the tap of the adjustable voltage divider composed of resistors R2, R3 which lies across the battery voltage $+U_B$. This tap is connected to the inverting input of a comparator 4 whose non-inverting input receives the capacitor voltage. The output of the comparator 4 is connected to the reset input R of the bistable flip-flop 1 causing it to be reset when the comparator switches. Accordingly, the output of the bistable flip-flop 1 is a pulse of duration tp+ts−tz and the constant time period "tz" is introduced by the additional adjustment made in the voltage correction circuit, for example by appropriate change of the resistor R1 or of one of the resistors R2 or R3 in the voltage divider circuit.

The decrease of the duration "ti" of the injection control pulse by the time "tz" may be compensated by increasing the multiplication factor M so that the relative increase δti as a function of "tp" for large values of "tp" becomes $$\delta ti = \frac{tz}{2\ tp\min} \cdot \left(1 - \frac{tp\min}{tp}\right) \text{ for } tp > tp\min.$$

Figure 2:
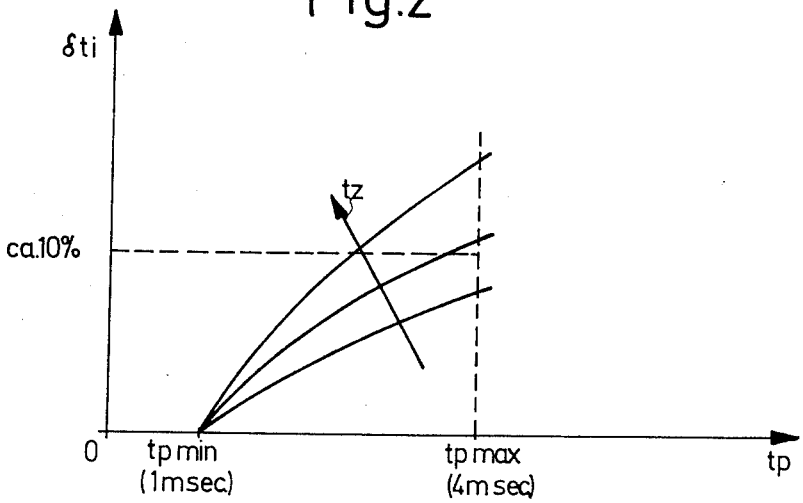
FIG. 2 is a diagram illustrating the enrichment factor δ ti as a function of the length of the fuel control pulses tp.

This functional relationship is illustrated in FIG. 2 in which the time "tz" is the common parameter. FIG. 2 is a graph with the enrichment factor $St_i$ plotted on the ordinate and the length of the fuel control pulse $t_p$ plotted on the abcissa. The various curves represent various values of the constant time period $t_z$ in an increasing direction indicated by the arrow.

It has been found by experiments that, when the battery voltage $U_B$ is 14 volts, the valve delay time tv=tan−tab is approximately 0.4 msec and this valve delay time decreases at the rate of 125 μsec/V with increasing battery voltage. If it is intended that the basic voltage correction be effective up to a battery voltage $U_B$ of 15 volts, the voltage correction time "ts" must be at least 125 μsec so that the constant time "tz" may then be 0.275 msec. When tpmax (the largest pre-control pulse) is 4 msec, the enrichment δti is 10.3% which is approximately what is required.

In special cases, the voltage correction time "ts" may be made larger by a constant and well-defined amount than the valve delay time "tv". In that case, the algebraic sign of the time "tz" is reversed and the fuel-air mixture is leaned out with increasing engine load.

Figure 3:
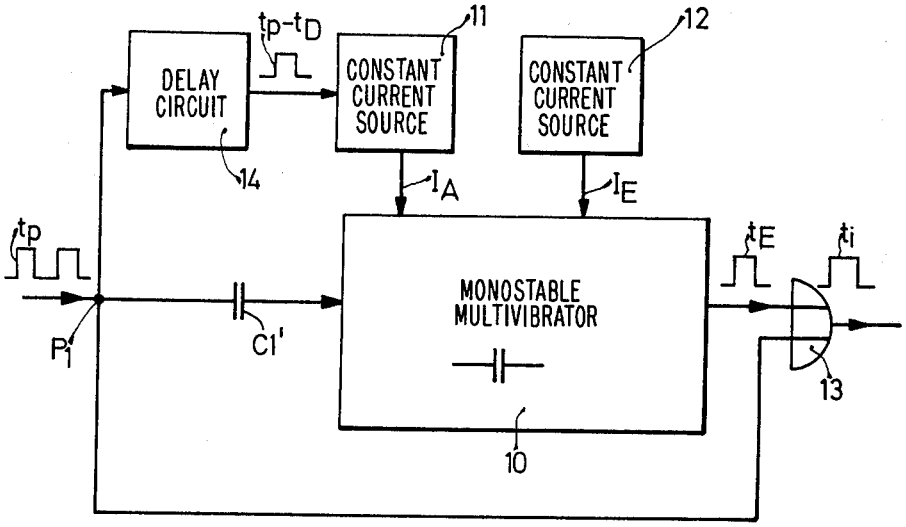
FIG. 3 is a block diagram of the multiplying stage of a fuel injection system including a delay circuit for load correction.

A second possibility for carrying out a load-dependent correction to compensate for changing induction tube pressures, is to cause a delay in the charging rate of the multiplying circuit associated with the fuel injection system. In FIG. 3 there is illustrated a schematic block diagram of such a known multiplying circuit which receives at its input P1 the above-referred to pre-pulses generated by the dividing control multivibrator and having a duration "tp". In the simplest case, this multiplying circuit is a monostable flip-flop 10 having two associated constant current sources 11 and 12, the former being a constant current source 11 which is used as a charging source and a constant current source 12 used as a discharge current source (sink). During the time "tp" of the pre-control pulse from the control multivibrator, a capacitor C1' in the multiplying circuit is charged with a constant current, after which the flip-flop 10 is triggered, causing the discharge of the same capacitor C1' at some constant discharge current. The discharge time $t_E$ is the unstable time constant of the monostable flip-flop 10; by juxtaposition via an OR gate 13 for example, the pulse of length "$t_E$" is added to the pulse of length "tp" to thereby generate an output control pulse "ti" which is intended to correspond in length to the actual opening time of the electromagnetic fuel injection valves. The known fuel injection system normally provides for adjustment of the charging current $I_A$ and the discharge current $I_E$ on the basis of prevailing operational states of the engine. In the normal case these currents are of approximately the same magnitude.

The load-dependent correction of this control pulse "ti" by an amount δti is now obtained by permitting the charging of the capacitor C1' only during part of the duration of the pulse "tp", i.e. during a time $tp-t_D$. By delaying the onset of charging of the capacitor within the multiplying circuit by a small amount of time "$t_D$" with respect to the onset of the pulse "tp", the capacitor C1' receives relatively less charge when "tp" is small than when "tp" is large. Accordingly, small injection pulses are affected to a greater degree than are large ones so that by also adjusting the magnitude of the charging and discharging currents in the proper way, it is possible to obtain the desired injection time of ti=2tp when tp=tpmin, i.e. tp is the shortest possible pre-control pulse. When tp>tpmin, the desired enrichment follows the formula:

$$\delta ti = \tfrac{1}{2} \cdot \frac{t_D}{tp\min - t_D} \cdot \left(1 - \frac{tp\min}{tp}\right); tp > tp\min$$

Figure 4:
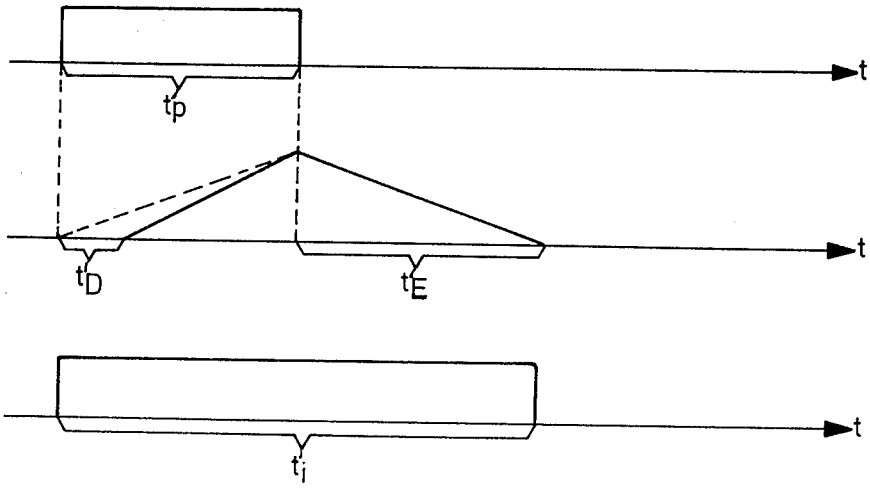
FIG. 4 is a set of diagrams illustrating various voltages in the circuit as a function of time.

This function is of the same character as the above-described load correction function which was obtained by suitably altering the voltage correction factor. FIG. 4 illustrates the voltages occurring when load correction is obtained in this way by delaying the charging of the capacitor C1' in the multiplying circuit of the fuel injection system. The charging of this capacitor C1' in the multiplying circuit is actually delayed by means of a delay circuit 14 (see FIG. 3) which generates a pulse of duration $tp-t_D$ whose onset is delayed with respect to the onset of the pulse "tp" by the amount "$t_D$".

Figure 5:
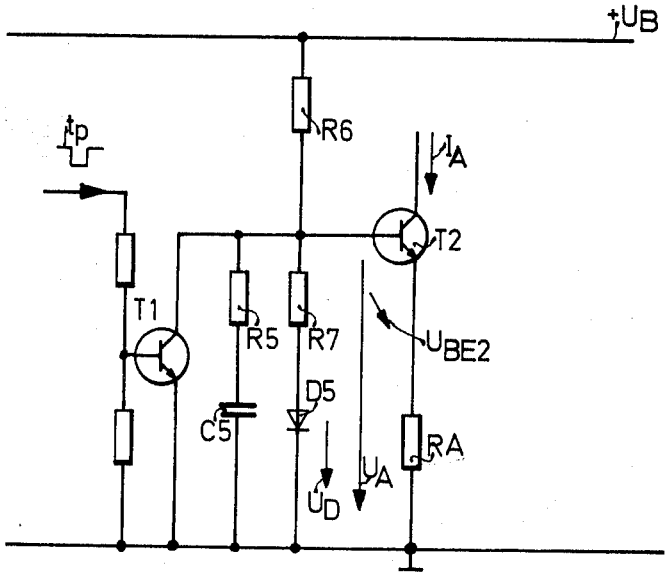
FIG. 5 is a detailed circuit diagram for performing the delayed onset of the charging current in the system of FIG. 3.

The delay circuit 14 is illustrated in detail in FIG. 5 where the pre-control pulse "tp" is seen to be delivered to a voltage divider circuit whose tap is connected to the base of a transistor T1. This transistor T1 together with the capacitor C5 and its series resistor R5 is the part of the circuit which causes the delayed turn-on of the charging current $I_A$. The charging current $I_A$ is supplied by a transistor T2 whose base is connected to the collector of the transistor T1. At the onset of the pulse "tp", the transistor T1 is blocked and the capacitor C5 has been discharged via the resistor R5. The resistor R5 is of relatively low value and is present primarily for protecting the transistor T1 against excessive currents. The base of the transistor T2 is connected to the tap of a voltage divider consisting of a resistor R6, a resistor R7 and a diode D5, all connected across the battery voltage $U_B$. After the onset of the pulse "tp", the voltage $U_A'$ present at the base of the transistor T2 increases slowly, thereby causing the charging current $I_A$ flowing into the collector of the transistor T2 to approach its maximum value only slowly. This delay also takes place if the voltage $U_A'$ is formed mainly by the base-emitter voltage $U_{BE2}$ of the transistor T2 because the voltage on the capacitor C5 must rise to at least the difference between $U_{BE2}$ and the saturation voltage of the transistor T1 before any charging current $I_A$ flows at all. The delay may be increased by connecting one or more (preferably one) diodes in series with the emitter resistor $R_A$ of the transistor T2. The diode D5 serves for temperature compensation and an appropriate number of diodes would have to be connected in series with the diode D5 in that case. If corrections larger than approximately ti=10% are required for full-load operation, this type of delay correction may be combined with the previously described adjustment of the voltage correction which represents the first embodiment illustrated in FIG. 1.

Figure 6:
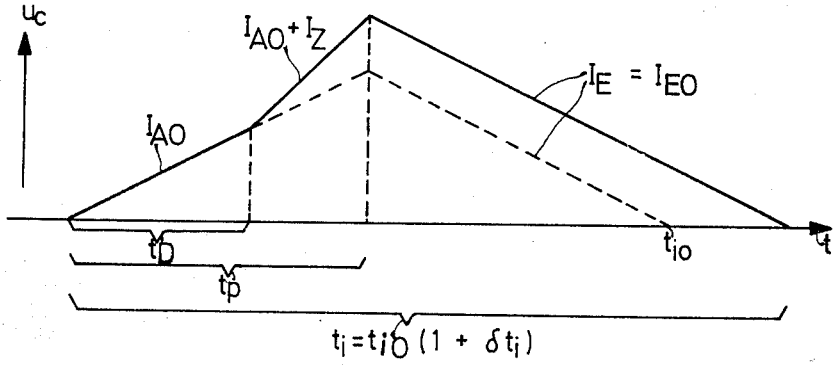
FIG. 6 is a set of diagrams illustrating load-dependent correction only in one load domain.

The two described methods for obtaining a load-dependent correction to generate a supplementary time δti both operate in the entire domain of the values of "tp". If it is desired to obtain a load correction which is effective only in the domain of high loads, that may be done by a time-dependent charging process of the capacitor C1' in the multiplier circuit of FIG. 3. The basic principle of such a time-dependent charging may be seen illustrated in FIG. 6. A circuit for changing the charging current in this manner will be described with relation to FIG. 7. The process illustrated in FIG. 6 is such that, at the onset of the pulse "tp", the charging current first delivers the normal charging current $I_{AO}$. After the expiration of a delay "$t_D$", to be discussed in more detail below, the charging current is increased by a supplementary amount $I_z$. In this manner, pre-control times "tp" which are equal to or smaller than the delay time "$t_D$" are multiplied at the normal multiplication factor of $M_o=2$. However, times of "tp" which are larger than "$t_D$" are multiplied by an increasing multiplication factor M. The relative deviation of the injection time "ti" from its normal value as a function of "tp" then follows these relations:

$$\text{for } tp \leqq t_D: \delta ti = 0 \qquad 1.$$

-continued $$\text{for } tp > t_D: \delta ti = \tfrac{1}{2} \cdot \frac{I_z}{I_{AO}} \cdot \left(1 - \frac{t_D}{tp}\right) \quad 2.$$

Figure 8:
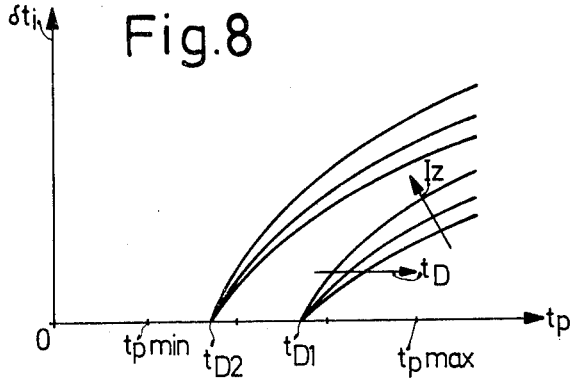
FIG. 8 is a set of diagrams illustrating various members of a family of curves of the additional duration δti as a function of the length of the pre-pulse tp.

The diagram of FIG. 8 illustrates the various functions $\delta ti = f(tp)$ with the values $I_Z$ and $t_D$ as parameters. FIG. 8 is similar to FIG. 2 with the parameter $t_D$ (delay time) imposed on the curves in an increasing direction as indicated by the arrow. The various curves are shown for two delay times $t_{D1}$ and $t_{D2}$ and are drawn for two variable parameters $I_z$ and $t_D$.

It should be noted that, in the delayed onset of charging current which was the second method according to the invention for obtaining load correction, the air-fuel ratio cannot be leaned out with increasing load because the delay time $t_D$ must always be positive. However, in the time-dependent charging of the multiplying circuit disclosed in the third method (see directly above), it is possible to decrease the charging current at the time $t_D$ so as to obtain negative corrections of $\delta ti$ as a function of load (corresponding to a leaning of the mixture). More complicated and constant correction functions $\delta ti = f(tp)$ are also possible if the charging current is, for example, increased in one part and decreased in another. The same corrections can also be applied to the discharging current for the capacitor in the multiplier circuit and this possibility will be discussed as the fourth method according to the invention for obtaining load-dependent correction of the injection pulse.

Figure 7:
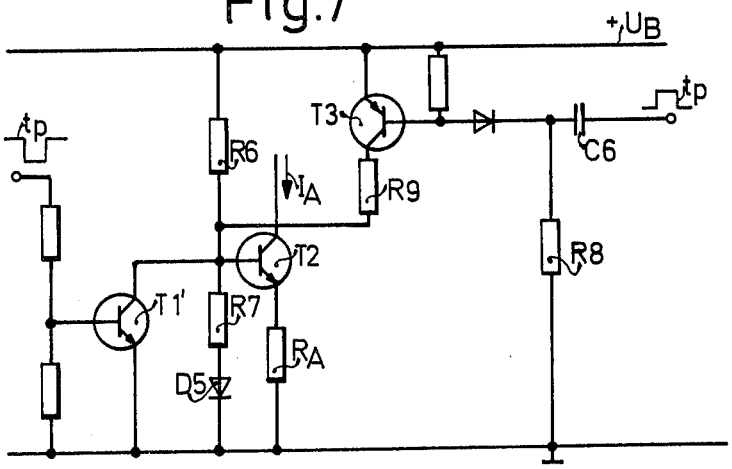
FIG. 7 is a detailed circuit diagram for increasing the charging current in a system of FIG. 3.

A circuit which may be used to delay the charging current by an amount $t_D$ is illustrated in FIG. 7 although the same correction could also, in principle, be performed in the circuit of FIG. 5. In FIG. 7, the charging current $I_A$ is again supplied by the transistor T2 having an emitter resistor $R_A$. The transistor T1' only determines the onset of the charging current $I_A$ inasmuch as it is blocked by the pulse "tp" so that the base voltage divider circuit R6, R7 and D5 connected to the transistor T2 is made effective. At the same time, however, the RC combination of the capacitor C6 and a resistor R8 causes a third transistor T3 to be rendered conducting after some delay $t_D$ determined by the time constants of the RC member. The current flowing through the transistor T3 raises the voltage at the base of the transistor T2 and thus increases the charging current $I_A$. It will be appreciated that this manner of operation substantially generates the charging function for the capacitor within the multiplying circuit 10 as illustrated in the diagram of FIG. 6. It is also possible to connect the resistor R9 to the emitter of the transistor T2 rather than to its base. In that case, the charging current is decreased after the expiration of the delay time $t_D$. A person skilled in the art will appreciate that other connections may be made to obtain different functions for obtaining the charging current.

Figure 9:
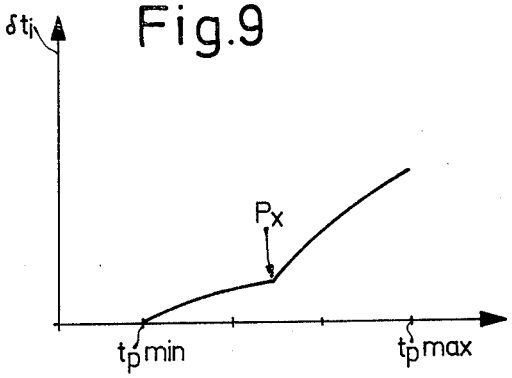
FIG. 9 is a diagram illustrating an arbitrary curve of δti as a function of pulse length tp.

The last described third method and the associated circuits for changing the control pulse, and the first method (voltage correction), or the second method (delay of charging of the capacitor), may be combined to obtain functions for example as illustrated in FIG. 9. The position of the point of inflection $P_x$ may be chosen at will, so that relatively complicated functions $\delta ti = f(tp)$ may be realized approximately without great effort.

Figure 10:
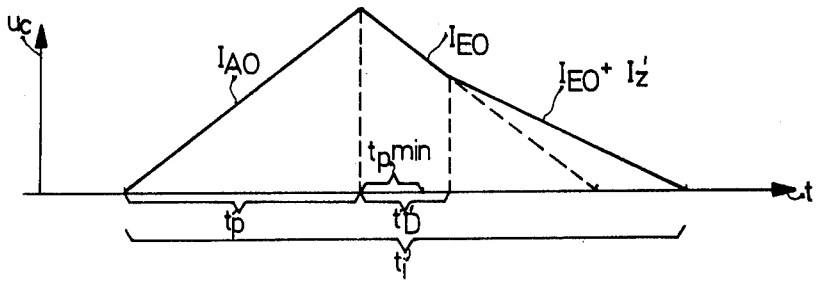
FIG. 10 is a diagram illustrating the charging and discharging in the multiplying stage of a fuel injection system when the discharging process is made load-dependent.

The fourth and final method according to the present invention for carrying out a load-dependent correction of the fuel injection control pulses "ti" is to change the discharging process of the capacitor within the multiplying circuit as a function of time, as illustrated in principle in the diagram of FIG. 10. The same general corrections as described for the third embodiment may also be used here where, after the expiration of a time $t_D'$, the discharging current is reduced for example by a value $I_z'$. In close analogy to that third embodiment where the correction is made by a time-dependent charging of the capacitor, the present time-dependent discharging of the capacitor follows the relations $$\text{for } tp \leqq t_D' \ \delta ti = 0$$

$$\text{for } tp > t_D' \ \delta ti = \tfrac{1}{2} \cdot \frac{I_z}{I_{EO} - I_z} \left(1 - \frac{t_D}{tp}\right)$$

An actual circuit for performing the adjustment of this fourth method could be similar to that shown in the circuit diagram of FIG. 7 because the current source formed by the transistor T2 may also be used as a discharge current source (sink). The timing circuit could be, for example, a monostable flip-flop which is triggered at the termination of the pulse "tp" and whose time constant is $t_D'$ at the expiration of which the additional current $I_z$ is added.

Figure 11:
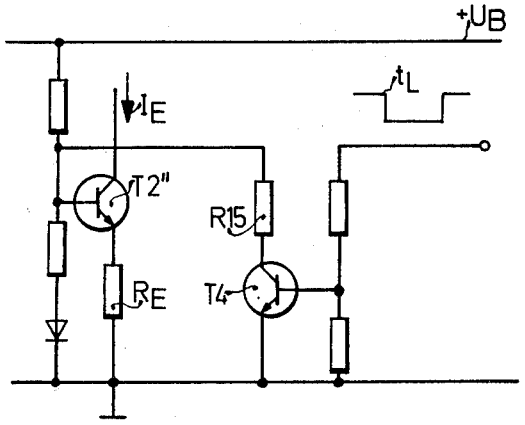
FIG. 11 is a circuit diagram illustrating a circuit for reducing the discharging current of the capacitor in a multiplying circuit such as illustrated in FIG. 3.

However, it may be possible to use other pulses already present in the fuel injection system so that no special timing circuit is required to change the discharging current. For example, if the known pulse-forming circuit of the fuel injection is used for generating the time delay $t_D'$, then the time constant $t_L$ of the pulse shaping stage may be chosen to select the time of decrease of the discharging current by using, for example, the circuit illustrated in FIG. 11 in which the transistor T2'' is the discharge current source, carrying a discharging current $I_E$ and where there is provided a further transistor T4 which, after the expiration of a time $t_D'$ after the onset of discharging, is made conducting by a suitable control pulse $t_L$ and then pulls down the base voltage of the transistor T2'' to thereby cause a decrease of the discharging current $I_E$, for example as illustrated in FIG. 10.

Finally, it should be noted that when an internal combustion engine is operated at full-load, the fuel metering is often performed to deliver maximum power rather than low exhaust gas emission so that the fuel-air mixture is often enriched, permitting maximum engine power. Under those conditions, the fuel control pulses "ti" are often prolonged by approximately 15–20% when the pre-control pulse "tp" is large so that the last two methods, i.e. the time-dependent charging and discharging of the capacitor in the control multiplier circuit may also be used for obtaining full-load enrichment. This may be done, for example, by choosing the delay time so that the enrichment takes place only just below the maximum value of "tp" (tpmax) and by providing a relatively high current $I_z$ causing a sharp increase of the correction so that, when p=tpmax, the enrichment factor is approximately 20%. If this method of full-load enrichment is used, it is possible to disperse with an electrical contact within the region of the throttle valve for indicating the full-load condition.

The foregoing related to preferred exemplary embodiments of the invention, it being understood that other embodiments and variants thereof are possible within the spirit and scope of the invention.

What is claimed and desired to be secured by Letters Patent of the United States is:

1. In a fuel injection system for an internal combustion engine, said system including means for generating preliminary electrical fuel control pulses "tp" whose pulse length is a function of engine speed and air flow rate and further means to generate from said preliminary pulses "tp" a train of valve-actuating pulses "ti", comprising:

said generating means including a pulse length multiplier circuit for generating valve-actuating pulses "ti" from said preliminary pulses "tp", said multiplier circuit including a timing capacitor and a charging current force therefor for continuously extending the length of said valve-actuating pulses "ti" in dependence on continuously varying engine load conditions, said load conditions being derived from the duration of said preliminary pulses "tp", a delaying circuit connected to said charging current source and delaying the onset of charging of said capacitor at least with the full charging current in said multiplier circuit by a predetermined amount of time "$t_D$" beyond the onset of preliminary pulses "tp", said delaying circuit including a timing circuit additionally triggered by said preliminary pulse and increasing the charging current for said capacitor by a predetermined amount "$I_z$" after a given time delay, said timing circuit including a voltage divider circuit having a tap, a transistor "T3" whose collector-emitter path is connected with said tap of said voltage divider circuit, and a transistor "T2" having a base constituting said charging current source, said tap being connected to said base of said transistor "T2" and wherein an input to said transistor "T3" is connected to an RC member whose time constant causes said transistor "T3" to increase the current through said charging transistor "T2" after a predetermined amount of time.

2. An apparatus as defined by claim 1, wherein said generating means includes means applying triggering signals $t_E$ in parallel with said preliminary pulses "tp" control said engine load conditions derived from the duration of said preliminary pulses "tp".

3. An apparatus as defined by claim 1, wherein said fuel injection system includes a voltage correction circuit for changing the value of said valve-actuating pulses "ti" to compensate for supply voltage changes and for producing a voltage correction signal "ts", said voltage correction circuit including a bistable multivibrator, a comparator circuit one input of which receives a signal related to supply voltage for resetting said multivibrator means continuously extending the length of said valve-actuating pulses "ti" for reducing the voltage correction signal "ts" supplied by said voltage correction circuit by a constant amount "tz".

* * * * *